US012275049B2

(12) United States Patent
Pagliari

(10) Patent No.: US 12,275,049 B2
(45) Date of Patent: Apr. 15, 2025

(54) METHOD FOR PACKING WELDING WIRE INSIDE CONTAINERS

(71) Applicant: Kopernik SA, Luxembourg (CH)

(72) Inventor: Mirko Pagliari, Coldrerio (CH)

(73) Assignee: Kopernik SA, Luxembourg (LU)

( * ) Notice: Subject to any disclaimer, the term of this patent is extended or adjusted under 35 U.S.C. 154(b) by 306 days.

(21) Appl. No.: 17/772,309

(22) PCT Filed: Oct. 27, 2020

(86) PCT No.: PCT/IB2020/060043
§ 371 (c)(1),
(2) Date: Apr. 27, 2022

(87) PCT Pub. No.: WO2021/084406
PCT Pub. Date: May 6, 2021

(65) Prior Publication Data

US 2022/0410236 A1 Dec. 29, 2022

(30) Foreign Application Priority Data

Oct. 29, 2019 (CH) ..... 01367/19

(51) Int. Cl.
*B21C 47/14* (2006.01)

(52) U.S. Cl.
CPC ..... *B21C 47/143* (2013.01)

(58) Field of Classification Search
CPC ..... B65H 57/12; B65H 54/80; B65H 54/40; B65H 54/76; B65H 54/10; B65H 75/02;
(Continued)

(56) References Cited

U.S. PATENT DOCUMENTS 224,942 A * 2/1880 Morgan et al. ..... B21C 47/14
242/533.4
2,157,811 A * 5/1939 Beach ..... B21C 47/143
242/362.3

(Continued)

FOREIGN PATENT DOCUMENTS

CA 1231082 1/1988
CN 101811629 8/2010

(Continued)

OTHER PUBLICATIONS

International Search Report and Written Opinion issued in corresponding foreign Application, PCT/IB2020/060043 pp. 1-10.

*Primary Examiner* — Michael R Mansen
*Assistant Examiner* — Henrix Soto

(57) ABSTRACT

The invention has as its object a method for packing a welding wire (25) inside a container (40) which includes at least the following steps:

- a feeding phase of said welding wire (25) inside a tube (13) placed in rotation to produce a prefixed torsion at each wire loop (25);
- a winding phase of the wire (25) coming out of said tube in rotation (13) on a core (20) configured to wind said wire (25) on it, said core (20) being provided with an alternative movement in a substantially vertical direction;
- a wire cutting phase (25) at the end of said wire winding phase on the core to (20) and;
- a core pick-up phase with the wire (25) wound on it and a core introduction phase (20) with the wire (25) wound on it inside a container (40).

10 Claims, 4 Drawing Sheets

(58) Field of Classification Search
CPC ..... B21C 47/143; B21C 47/14; B21C 47/04; B21C 47/323; B65D 85/04
USPC ..... 242/476.6
See application file for complete search history.

(56) References Cited

U.S. PATENT DOCUMENTS 2,849,194 A * 8/1958 Henning ..... B65H 54/80 242/615.1
2,849,195 A * 8/1958 Kovaleski ..... B21C 47/146 242/615.3
2,900,073 A * 8/1959 Charles ..... B21C 47/143 242/361
2,931,588 A * 4/1960 Bunch ..... B65H 59/381 242/414
3,000,493 A * 9/1961 Hirst ..... B65H 75/14 242/171
3,082,868 A * 3/1963 Hubbard ..... B65H 63/086 242/129.5
3,111,286 A * 11/1963 Lorenz ..... B21C 47/14 242/361.4
3,503,197 A * 3/1970 Fess ..... D01H 1/00 19/159 R
3,926,382 A * 12/1975 Sieurin ..... B21C 47/10 242/363
4,164,331 A 8/1979 Henrich
4,411,394 A * 10/1983 Starvaski ..... B21C 47/045 242/362.2
4,580,399 A 4/1986 Henrich
4,582,198 A * 4/1986 Ditton ..... B65D 71/0096 229/160
6,019,303 A * 2/2000 Cooper ..... B21C 47/14 242/361.4
8,733,683 B2 * 5/2014 Mantovan ..... B21C 47/04 242/472.5
2005/0023401 A1 2/2005 Hsu
2013/0161430 A1 * 6/2013 Weissbrod ..... B23K 9/1333 242/125.1

FOREIGN PATENT DOCUMENTS

DE 2323175 11/1973
DE 2604012 8/1977
DE 3320250 4/1984
EP 0109539 5/1984
FI 1833841 4/1984
GB 1363441 A * 8/1974 ..... B65H 54/80
JP S4961661 6/1974
JP S5129670 3/1976
JP S5295560 8/1977
JP S55145971 A * 11/1980
JP H05246623 A * 9/1993
JP H0725480 3/1995
JP H1171059 A 3/1999
JP 200010357 4/2000
JP 2010195522 9/2010
KR 20100097062 9/2010
NL 2004287 2/2013

* cited by examiner

METHOD FOR PACKING WELDING WIRE INSIDE CONTAINERS

CROSS-REFERENCE TO RELATED APPLICATIONS

The present application is a 371 national phase application of International Application No. PCT/IB2020/060043 filed Oct. 27, 2020, which claims priority to and the benefit of CH 01367/19 filed Oct. 29, 2019, the contents of which are incorporated herein by reference and made a part hereof.

FIELD OF INVENTION

The present invention concerns a method for packing a welding wire inside drums or more generally in large capacity containers, for example from 100 to 1000 kg of wire each.

These containers, after packaging, are shipped, stored and progressively used by the end users who weld with this welding wire.

In such large capacity drums or containers welding wires of various kinds are packed, such as in particular alloyed or unalloyed solid metal wires (MIG=Metal Inert Gas/MAG=Metal Active Gas), stainless steel wires, aluminium wires, and flux cored wires (FCW=Flux Cored Wire).

PRIOR ART

As it is known, welding wire is normally supplied wrapped on metal or plastic drums from 1 kg to 20 kg. The drum is positioned on the unwinder of a welding machine and the wire is unwound by means of wire tow rollers that push it through the sheath towards the welding torch where the wire is melted and deposited on two metal parts in order to join them.

In robotic and automated applications, which aim to maximize efficiency and productivity, the use of large capacity containers, particularly drums from 50 kg to over 500 kg, has become the most common practice. Initially the practice, now obsolete, was to position these drums on rotary tables whose rotation, synchronized with the wire feed, helped unwinding and feeding the wire from the drum.

Later on, for reasons of limited workshop space, efficiency and flexibility and safety in handling and positioning the drums themselves, the use of so-called No-twist or Twist-free welding wire drums has spread rapidly.

This type of packaging, together with the special system for positioning the wire inside the drum, which has been known for some decades, allows the wire to be used for welding by positioning the drum in which it is contained directly on the floor, or by leaving it on its own pallet, without the need to rotate the drum, which is therefore stationary. In order for the drum to be stationary, the Twist-free packaging system requires that when the welding wire is inserted, in the form of several free loops, into the drum itself, a 360 degree twist is applied to each loop of wire. When the wire is extracted from the top of the drum during use, since this is stationary, a 360 degree reverse twist is applied to each loop, but this reverse twist is simply cancelled out by the intentionally applied twist when packing the wire into the drum.

The production mode of the common known Twist-free drum is illustrated in FIG. 1 and globally indicated with the numerical reference 10'.

The welding wire 25' is straightened by a system of rollers 11' and pushed forward in the direction indicated by the arrow F2 towards the so-called flyer by a wheel or capstan 12' that rotates in the direction of the arrow F1. The wire 25' in the flyer passes inside a tube 13', slightly larger than the diameter of the wire 25'.

The tube 13' is placed in rotation around a substantially vertical axis X', as indicated by the arrow F3, and in this way it applies a 360 degrees twist to each welding wire 25' loop. At the exit of the tube 13', the wire 25' is free and falls without perfect control over a coil 30' of wire that is already present in an underlying drum 40' at that moment. Note the high distance D between the coil just after the exit from the tube 13' and the coil of wire on the bottom of the 40' drum. The drum 40' moves downwards, as indicated by the arrow F5', as the drum fills up, trying to maintain the same height difference D between the tube 13' and the coil 30' of wire. The drum 40' is also placed in rotation as indicated by the arrow F4', in order to give a certain width to the coil 30'. For the same purpose please note that the centre of the coil is not aligned with the centre of the flyer carrying the rotating tube 13'. In fact, the rotation axis X' of the rotating tube 13' is distinct from the rotation axis X" of the coil 30' of wire. The drum 40', indicated in a circular section in FIG. 1, can also be polygonal in shape (8, 16, 24 sides etc.) and can have different diameters and heights.

Packing or packaging a welding wire into a container or drum while applying complete twists for each individual loop is not an easy operation and involves the wire loop being dropped free, generally from a height comprised between 30 and 70 mm, on the bottom of the drum or on the layer of wire already present in the container until the desired amount of wire is reached. This procedure involves more than one problem, also due to the considerable upward and radial expansion forces generated by the packaged wire, which prevent the wire from being arranged perfectly neatly inside the drum. These problems become even more apparent when the diameter of the drum is reduced, when the tensile strength and therefore the stiffness of the wire increases and when the diameter of the wire is larger.

Said problems may result in the discarding of some wire drums due to inadequate packaging or packing quality, resulting in reworking or scrapping of the material contained in the drum by the manufacturer. However, the most negative consequence is certainly the possibility of knots occurring at the end customer using the drum to weld, with consequent jamming of the robotic system and consequent loss of production and sometimes production of defective parts. All manufacturers of wire packed in Twist-free drums are faced with more or less extensive customer complaints caused by unwanted knots. Some manufacturers have managed to reduce the occurrence of this problem, but none have been able to eliminate it.

The purpose of the present invention is therefore to solve said problems of the prior art by means of a method for packing welding wire inside containers that allows an improved reliability in the wire packing process.

A further aim of this invention is to solve said problems in a rational and economical way.

BRIEF DESCRIPTION OF THE INVENTION

These aims are achieved by a method for packing a welding wire inside a container, where the above method includes at least the following steps:

- a feeding phase of said welding wire inside a tube placed in rotation to produce a prefixed torsion at each wire loop;

a winding phase of the wire coming out of said tube in rotation on a core configured to wrap said wire on it, wherein said core is provided with an alternative upward and downward movement in a substantially vertical direction, so as to allow the winding of several layers of wire formed by coils of increasing diameter, until reaching a desired band width of a coil formed by the welding wire;

a wire cutting phase at the end of said wire winding phase on the core;

a core pick-up phase with the wire wound on it; and a phase of introduction of the core with the wire wrapped on it inside a container.

A packaging method as described by this invention has many advantages, which are listed below.

The invention method definitively eliminates the possibility of knots or jams being created during the unwinding of the wire by the end user.

This method always allows the control of the wire (not having the wire drop phase where there is no control of the wire positioning) and therefore it is highly reliable and repeatable and also eliminates the possibility of producing non-compliant drums and consequent reworking or scrapping in the production plant.

The packaging method itself results in a significantly higher packing density compared to the Twist-free drum currently in use; in a drum with a diameter of 52 cm and a height of about 80 cm, about 250 kg are packed by all wire producers to weld in drums, while the new system would allow a filling of at least 300 kg (+20%), but possibly up to 375 kg (+50%), resulting in considerable savings in storage space at producers and users; this higher net weight also implies a significant reduction in the incidence of the cost of packaging, respectively 16% and 33% in the two cases mentioned with a net weight of 300 and 375 kg.

The invention method, again by virtue of the total control of the wire during the packaging phase, involves the production of coils/killnuts/toroids of wire always with the same external diameter and the same height, with the same quantity packed, while the coil contained in the Twist-free drum currently in use is also significantly different in height from drum to drum, with the same quantity packed. It follows that the method of invention, coupled with a drum or container of suitable design, can be stacked during storage or transport, which is not possible for the Twist-free drum currently in use, saving space for manufacturers and users and sometimes reducing transport costs.

Further features of the invention can be inferred from the employee claims.

BRIEF DESCRIPTION OF THE FIGURES

Further features and advantages of the invention will be evident from reading the following description provided by way of example and not limitation, with the help of the figures illustrated in the attached tables.

DETAILED DESCRIPTION OF THE FIGURES

This invention will now be described with particular reference to the attached figures.

Figure 1:
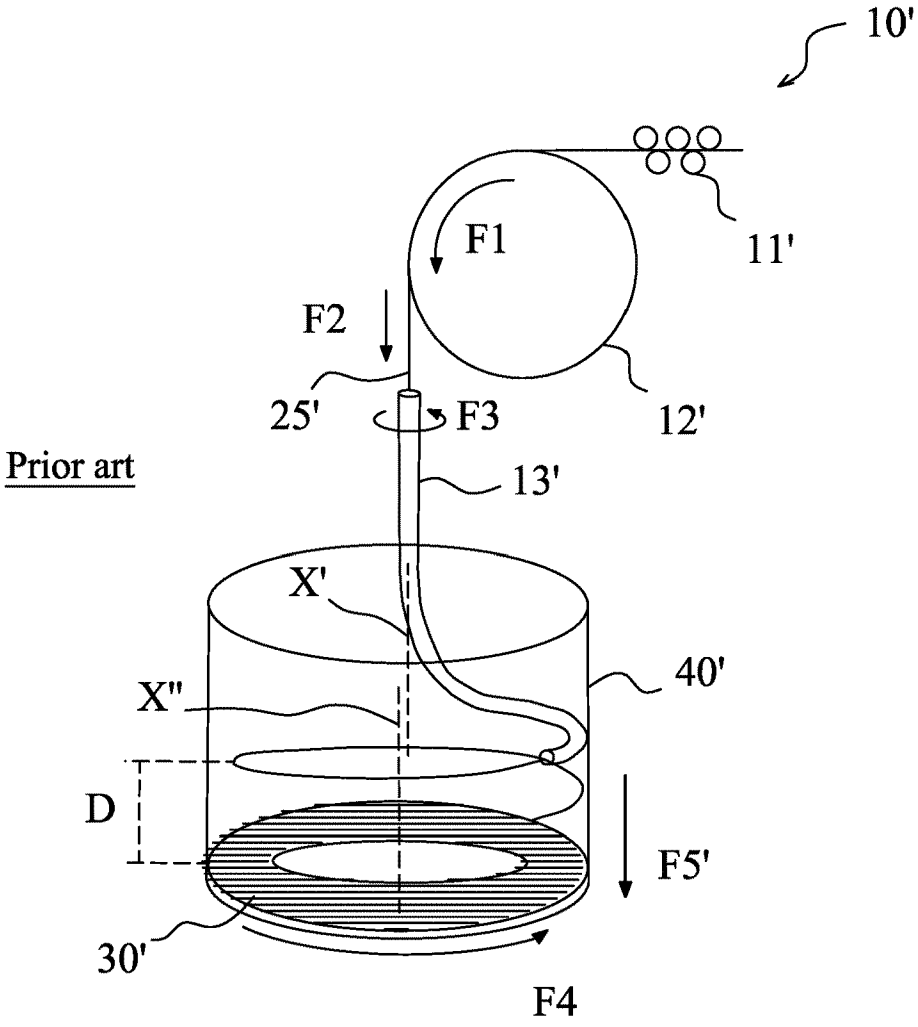
FIG.1 Prior art
FIG. 1 shows a method of packing a welding wire according to the prior art.

In particular, FIG. 1 illustrates a method of packing a welding wire according to the prior art already described in the introductory part of this description to which reference is hereby made.

Figure 2:
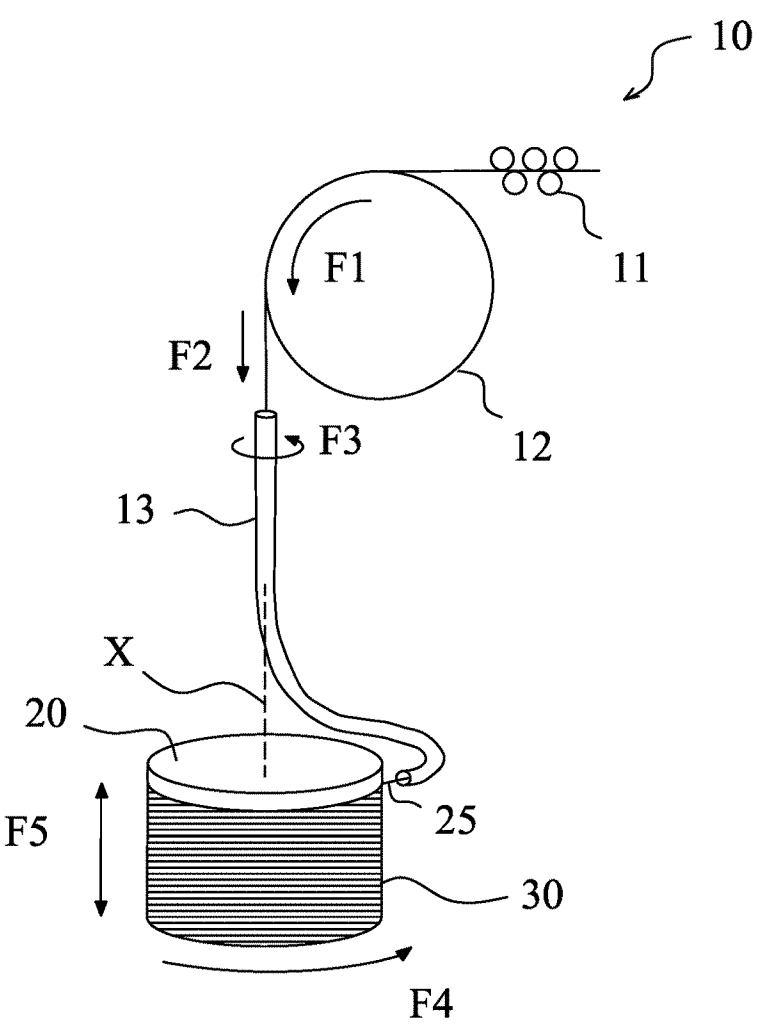
FIG. 2 represents a method of packing a welding wire according to one aspect of the invention.

FIG. 2 represents a method of packing a welding wire according to one aspect of the invention, globally indicated with the numerical reference 10.

Contrary to the by now common Twist-free drum, in which the loop of the wire is left to fall freely into the drum, forming a coil of wire with relatively low density and a shape that is not perfectly neat and repeatable, the mode that is object of the invention provides that while twisting is applied to the wire 25 it is wound around a core 20, preferably with a circular section, avoiding the step of falling out of control, and always maintaining control of the position and of the winding of the wire 25.

Figure 4:
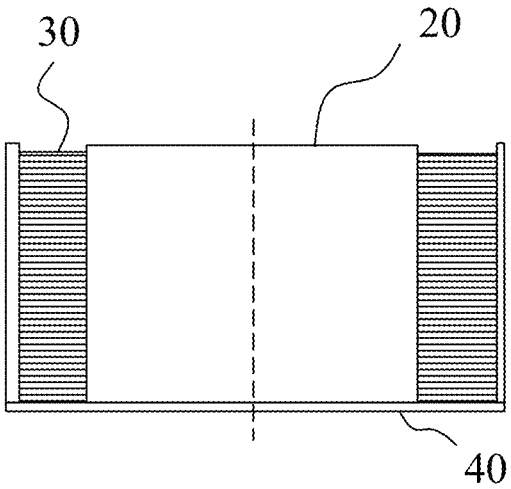
FIGS. 4 and 5 represent sectional views of a wire wound respectively on a cylindrical core and on a truncated cone core according to alternative aspects of the present invention.

The wire 25 is wound on the core 20, normally made of plastic or cardboard, in a continuous way distributing the wire 25 from one end 20 of the core to the other, repeatedly, in order to create a sort of toroid of wire, or coil 30 having relatively high density. It is also possible that this winding, always while a 360 degree twist is applied to each loop, is shaped as a truncated cone (FIG. 5) instead of a cylinder (FIG. 4).

In these two types of winding the diameter of the loops is initially almost equal to the diameter of the core 20, but as the diameter of the coil 30 of wire increases, the diameter of the coils becomes progressively larger; obviously the torsion of 360 degrees is always applied to each single coil and therefore there is also a decrease in the amount of torsion per unit of wire length 25.

Figure 3:
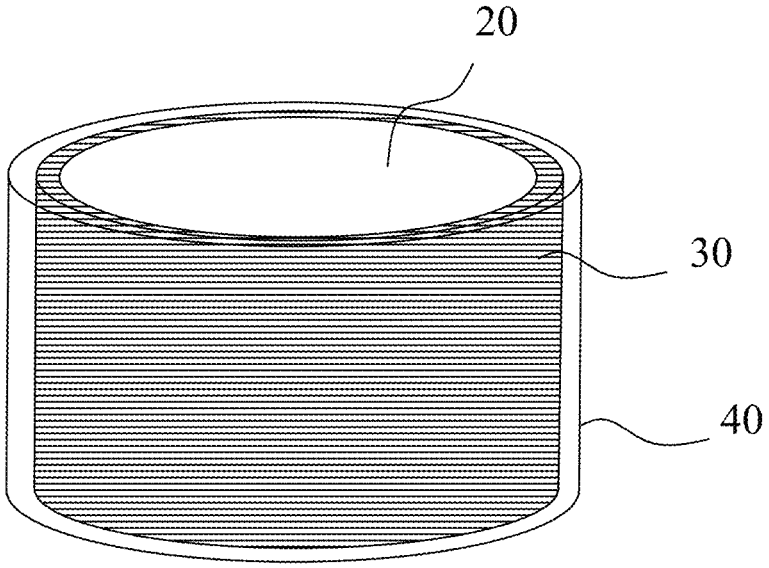
FIG. 3 represents a container containing welding wire wrapped on a core according to one aspect of the invention.

The coil 30 of welding wire made in this way is then placed inside a drum or container 40 with an internal diameter slightly larger than the external diameter of the coil 30 of wire, in order to be palletized and stored or transported to the end user (FIG. 3).

An implementation of the packaging method of the present invention is illustrated first of all in FIG. 2

The welding wire 25 is straightened by a roller system 11 and pushed forward in the direction indicated by the arrow F2 towards the so-called flyer by a wheel or capstan 12 which rotates in the direction of the arrow F1. The wire 25 in the flyer passes through a tube 13, slightly larger than the diameter of the wire 25.

The tube 13 is placed in rotation, around a vertical axis X, as indicated by the arrow F3 and applies a 360 degree twist to each loop of welding wire 25.

At the outlet of tube 13, in the method of the invention, wire 25 does not fall out of control, but instead is wound directly onto a core 20 of circular section, made of plastic or cardboard.

The core 20 moves alternately up and down, as indicated by the arrow F5, so as to wrap several layers of wire formed by coils of increasing diameter, until the desired band width of a coil 30 or toroid formed by the welding wire is reached.

Figure 5:
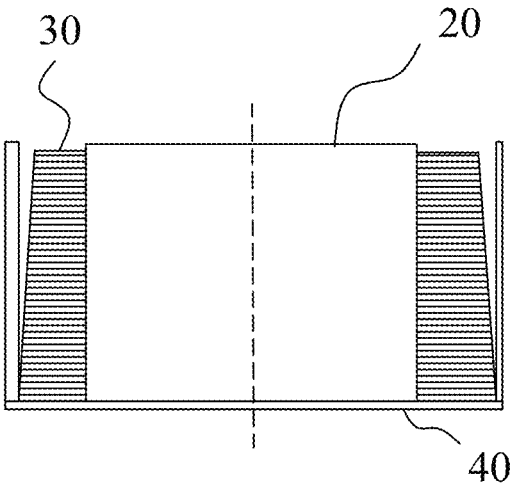

Note that the winding of the wire can be either cylindrical or truncated cone shaped, as better illustrated in FIGS. 4 and 5 respectively.

The core 20 is not in itself rotating, but is positioned above a table 80 equipped with a mechanism that allows it to rotate in the same direction as the flyer, i.e. in the direction of the arrow F4, if the thread tension of the wire 25 is too high, above a settable preset value. Note that the rotation axis of the core 20 is in this case aligned with the centre of the flyer carrying the rotating tube: i.e. the rotation axis X of the core 20 is aligned with the rotation axis of the tube 13. The core 20 indicated with circular section in the figure, can be of different diameters and heights, with diameters preferably at least 100 times the diameter of the wire to be packed.

Once the winding phase of welding wire 25 around the core 20 is completed, when the desired external diameter of the toroid or coil 30 of welding wire 25 is reached, the wire is cut and the coil 30 is ejected from the winding machine. On the outside of this machine, by means of an expansion pliers 50, equipped with jaws 55, which acts on the internal surface of the core 20, both the core 20 and the wire 25 are lifted onto it and inserted into a previously assembled drum or container 40 with an internal diameter slightly larger than the external diameter of the coil 30 of wire. The container 40 can also be polygonal in shape (8, 16, 24 sides etc.) and of different diameters and heights.

The internal height of the container 40 is preferably equal to the height of the coil 30 of wire. In this way, once the lid of container 40 has been positioned, it is in contact with the upper face of the coil 30, and in this way you will have a safe support and adequate resistance to be able to place the full containers on top of each other during transport or storage.

FIGS. 6*a*-6*g* represent successive steps of an implementation of the invention method, in which an example of a packaging operation is represented.

Figure 6A:
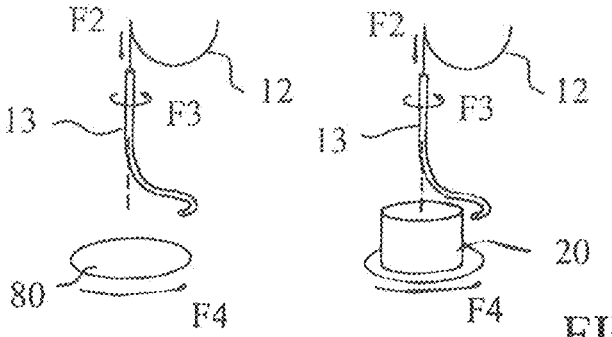
FIGS. 6*a*-6*g* represent successive steps of an implementation of the method of the invention.
Figure 6B:
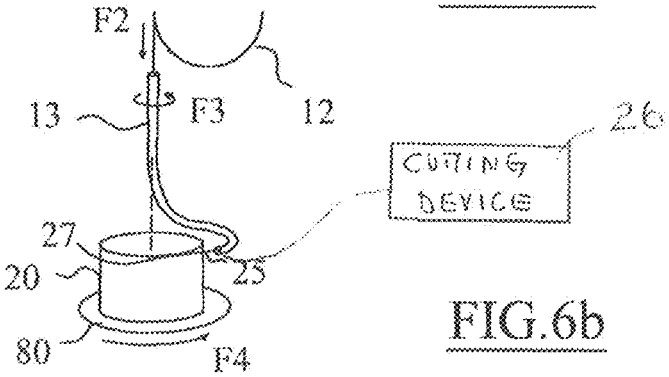
Figure 6C:
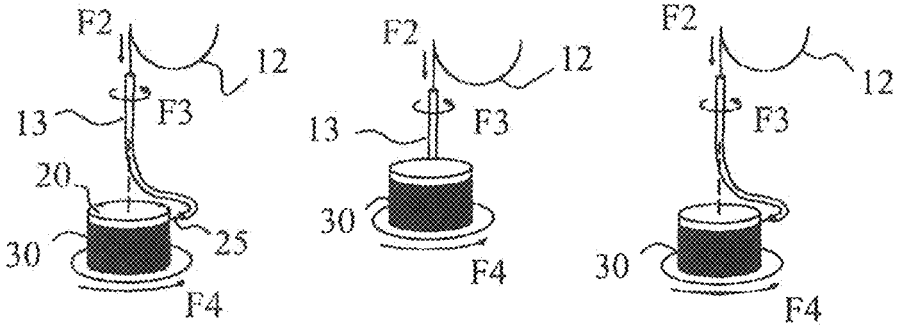
Figure 6D:
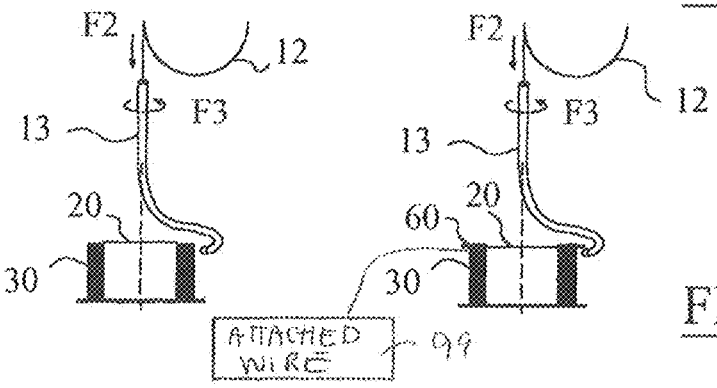
Figure 6E:
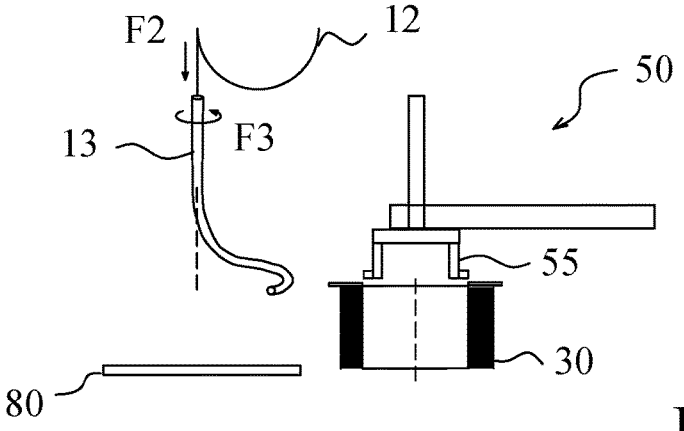
Figure 6F:
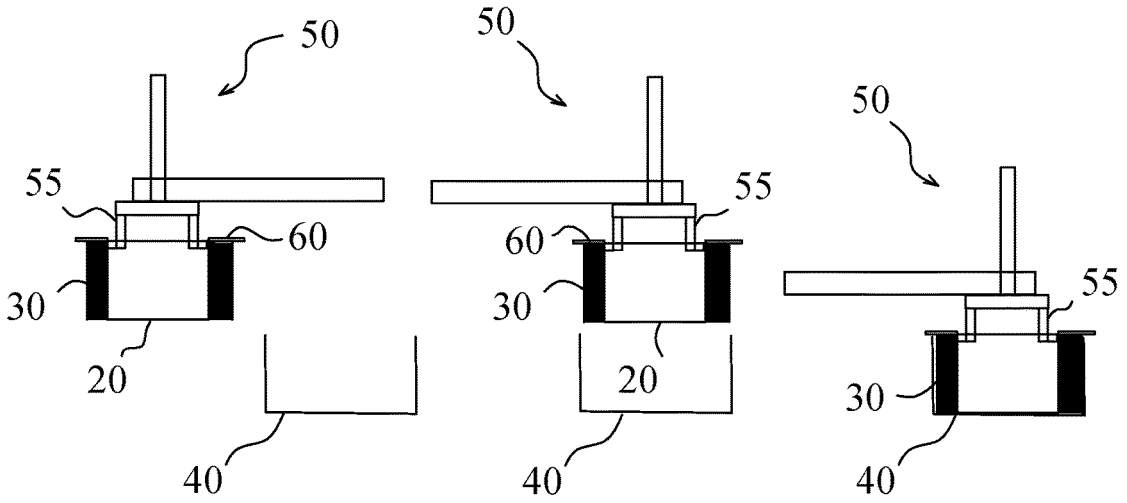
Figure 6G:
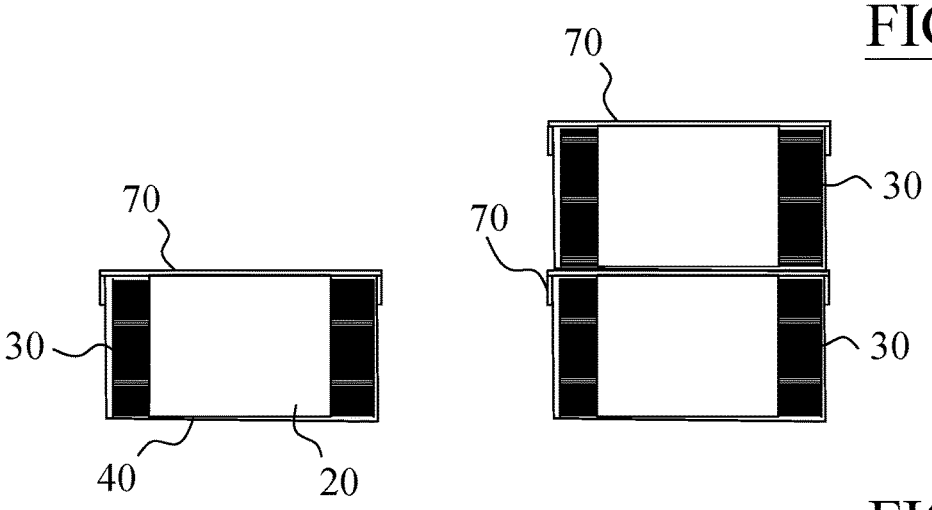

FIG. 6*a* shows the positioning of a cylindrical core 20, preferably made of plastic or cardboard, on a wire winding machine with a 360-degree twist for each loop, wherein said machine includes a rotating platform 80 supporting said core 20.

In a second phase (FIG. 6 *b*) the wire 25 is hooked to a hook hole 27 present on the core 20. FIG. 6 *b* also shows cutting device 26.

Then (FIG. 6*c*) the welding wire 25 is wound over the whole height of the core 20 at progressively increasing diameters until the desired outer diameter is reached.

After this phase, a temporary flange 60 is placed on the upper face of the coil 30 of wire and the end of the wire 25 is cut by cutting device 26 shown in FIG. 6 *b* and attached at the location as indicated by attached wire 99, to said temporary flange 60 which has a fixing hole (FIG. 6 *d*).

After this it is continued (FIG. 6*d*) to the extraction of the coil 30 of wire from the winding machine and its lifting by means of expansion grippers 50, or a functionally similar system, equipped with jaws 55 acting on the internal surface of the cylindrical core 20.

Then it is continued (FIG. 6*f*) to position the coil 30 of a large drum or container 40, with internal dimensions slightly larger than the external diameter of the coil 30 and with internal height preferably equal to the height of the coil 30 plus the height of the covering flange 60. The drum or container 40 can be cylindrical or even polygonal, e.g. square, octagonal or other.

Finally, it is continued (FIG. 6*g*) to the replacement of the temporary attaching flange 60 with a final flange 70 covering the upper face of the coil 30. It is also possible that the flange defined as temporary is actually the final flange and therefore this phase is not necessary. The final flange 70, or the temporary one if definitive, has the shape essentially of a disc with a central hole and is made of plastic or cardboard or even polymeric material.

It is also possible, although not strictly necessary, for the end of the wire to be unhooked from the final flange and hooked to the inside wall of the drum where there is a hook eyelet.

Finally, the drum or container 40 of large capacity is closed by a protection lid 80.

Please note that when using the coil of welding wire, the lid 80 is removed and generally replaced with a known unwinding cone.

Obviously, the invention as described can be modified or improved for contingent or particular reasons, without departing from the scope of the invention.

The invention claimed is:

1. A method for packing a welding wire inside a container, said method comprising the following steps:

feeding said welding wire inside a tube that rotates to produce a plurality of wire loops, each with a prefixed torsion;

winding said welding wire exiting said tube about a core disposed on a rotatable platform such that the platform is capable of rotation about a rotation axis to therefore rotate said core and produce a winding of said plurality of wire loops wound about said core, wherein said core is further moveable upwards and downwards in a substantially vertical direction along the rotation axis, so as to allow winding of several layers of wire formed by loops of increasing diameter, until reaching a desired band width of a coil formed by the wire loops;

cutting said welding wire after said winding on the core;

picking up said core with the winding wound on it; and positioning the core with the winding wound on it inside a container, wherein said feeding said welding wire inside a tube that rotates to produce said plurality of wire loops comprises a roller system pushing said wire into said tube, further comprising placing a flange on a top face of the core after said winding and prior to said picking up and attaching an end of said wire to a fixing hole in said flange.

2. The method as in claim 1, wherein the winding wound around said core has a cylindrical or truncated cone shape.

3. The method as in claim 1, further comprising freely rotating said platform thereby rotating said core about said rotation axis, said core rotating in the same direction of rotation of said rotating tube.

4. The method as in claim 3, wherein the rotation axis of said core is aligned with an axis of rotation of the tube.

5. The method as in claim 1, wherein the wire to be wound on said core is preliminarily hooked to a hooking hole present on the core itself.

6. The method as in claim 1, wherein the picking up said core with the winding wound on it is performed by using expansion pliers.

7. The method as in claim 1, further comprising said roller system straightening said wire.

8. The method as in claim 7, wherein said roller system comprises a plurality of rollers and a wheel or capstan that directs said wire into said tube.

9. The method as in claim 1, wherein the winding has a toroid shape.

10. A method for packing a welding wire inside a container, said method comprising:

feeding said welding wire inside a tube that rotates to produce a plurality of wire loops, each with a prefixed torsion;

winding said welding wire exiting said tube about a core disposed on a rotatable platform such that the platform and core are capable of rotation about a rotation axis, to produce a winding of said plurality of wire loops wrapped about said core, wherein said core is further moveable upwards and downwards in a substantially vertical direction along the rotation axis, so as to allow winding of several layers of wire formed by loops of increasing diameter, until reaching a desired band width of a coil formed by said welding wire;

cutting said welding wire at the end of said winding on the core;

picking up said core with the winding wound on it; and positioning the core with the winding wound on it inside a container, wherein said feeding said welding wire inside a tube that rotates to produce said plurality of wire loops comprises pushing said wire into said tube, the winding has a cylindrical or truncated cone shape, and further comprising freely rotating said platform thereby rotating said core about said rotation axis, said core rotating in the same direction of rotation as said rotating tube, wherein the rotation axis of said core is aligned with an axis of rotation of the tube, and further comprising placing a flange on a top face of the core after said winding and prior to said picking up and attaching a cut end of said wire to a fixing hole in said flange.

* * * * *